US008669223B2

(12) United States Patent
Silvernail et al.

(10) Patent No.: US 8,669,223 B2
(45) **Date of Patent: *Mar. 11, 2014**

(54) STABILITY ENHANCEMENT AGENT FOR SOLID DETERGENT COMPOSITIONS

(71) Applicant: Ecolab USA Inc., St. Paul, MN (US)

(72) Inventors: Carter M. Silvernail, Burnsville, MN (US); Kerrie Walters, Minneapolis, MN (US)

(73) Assignee: Ecolab USA Inc., Saint Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/719,383

(22) Filed: Dec. 19, 2012

(65) Prior Publication Data

US 2013/0109606 A1 May 2, 2013

Related U.S. Application Data

(63) Continuation of application No. 12/844,927, filed on Jul. 28, 2010, now Pat. No. 8,361,952.

(51) Int. Cl.

| | |
|---|---|
| ***C11D 17/00*** | (2006.01) |
| ***C11D 3/00*** | (2006.01) |
| ***C11D 3/10*** | (2006.01) |
| ***C11D 3/20*** | (2006.01) |
| ***C11D 7/12*** | (2006.01) |
| ***C11D 7/26*** | (2006.01) |
| ***B08B 7/00*** | (2006.01) |
| ***B08B 9/20*** | (2006.01) |

(52) U.S. Cl.

USPC ..... 510/445; 510/446; 510/220; 510/214; 510/224; 510/234; 510/235; 510/278; 510/298; 510/451; 510/477; 510/509; 510/513; 134/25.2; 134/42; 8/137

(58) Field of Classification Search

USPC ..... 510/445, 446, 220, 224, 234, 298, 451, 510/477, 509, 513, 214, 235, 278; 134/25.2, 42; 8/137

See application file for complete search history.

(56) References Cited

U.S. PATENT DOCUMENTS

| | | | |
|---|---|---|---|
| 4,443,355 | A | 4/1984 | Murata et al. |
| 4,654,159 | A | 3/1987 | Bush et al. |
| 4,687,592 | A | 8/1987 | Collins et al. |
| 4,846,650 | A | 7/1989 | Benedict et al. |
| 5,062,962 | A | 11/1991 | Brown et al. |
| 5,147,555 | A | 9/1992 | Brown et al. |
| 5,158,622 | A | 10/1992 | Reichgott et al. |
| 5,182,099 | A | 1/1993 | Jonsson et al. |
| 5,185,153 | A | 2/1993 | Pollock |
| 5,248,438 | A | 9/1993 | Perez |
| 5,256,332 | A | 10/1993 | Kessler |
| 5,326,478 | A | 7/1994 | Perez et al. |
| 5,332,505 | A | 7/1994 | Carey et al. |
| 5,368,704 | A | 11/1994 | Madou et al. |
| 5,368,740 | A | 11/1994 | Zidovec et al. |
| 5,378,372 | A | 1/1995 | Carey et al. |
| 5,397,493 | A | 3/1995 | Potocki |
| 5,409,062 | A | 4/1995 | Brown et al. |
| 5,486,294 | A | 1/1996 | Brown |
| 5,562,830 | A | 10/1996 | Zidovec et al. |
| 5,601,754 | A | 2/1997 | Carey et al. |
| 5,633,223 | A | 5/1997 | Vasudevan et al. |
| 5,635,447 | A | 6/1997 | Sanders |
| 5,705,077 | A | 1/1998 | Robertson |
| 5,712,239 | A | 1/1998 | Knowlton et al. |
| 5,776,883 | A | 7/1998 | Vasudevan |
| 5,866,011 | A | 2/1999 | McGiffney |
| 5,866,032 | A | 2/1999 | Carey et al. |
| 5,889,088 | A | 3/1999 | Kisuno et al. |
| 5,935,909 | A | 8/1999 | Sanders |
| 6,063,288 | A | 5/2000 | Roe |
| 6,077,440 | A | 6/2000 | Roe et al. |
| 6,126,859 | A | 10/2000 | Hunter et al. |
| 6,146,538 | A | 11/2000 | Martin |
| 6,153,657 | A | 11/2000 | Kisuno et al. |
| 6,180,589 | B1 | 1/2001 | Rodrigues et al. |
| 6,187,262 | B1 | 2/2001 | Cheng et al. |
| 6,241,788 | B1 | 6/2001 | Buentello et al. |
| 6,258,765 | B1 | 7/2001 | Wei et al. |
| 6,281,178 | B1 | 8/2001 | Ryklin et al. |
| 6,331,519 | B1 * | 12/2001 | Huff et al. ..... 510/475 |
| 6,333,005 | B1 | 12/2001 | Nguyen |
| 6,444,747 | B1 | 9/2002 | Chen et al. |
| 6,514,458 | B1 | 2/2003 | Czechowski et al. |
| 6,596,678 | B2 | 7/2003 | Panandiker et al. |
| 6,620,328 | B2 | 9/2003 | Zidovec |
| 6,645,400 | B2 | 11/2003 | Martin |

(Continued)

FOREIGN PATENT DOCUMENTS

| | | | |
|---|---|---|---|
| DE | 42 12 755 | A1 | 10/1993 |
| EP | 0 668 344 | B1 | 8/1995 |
| EP | 1 950 180 | A1 | 7/2008 |
| JP | 4-166298 | A | 6/1992 |
| JP | 2000-117292 | A | 4/2000 |
| JP | 2001-081184 | A | 3/2001 |
| WO | WO 01/62091 | A1 | 8/2001 |
| WO | WO 2006/045795 | A2 | 5/2006 |
| WO | WO 2008/090194 | A1 | 7/2008 |
| WO | WO 2009/061224 | A1 | 5/2009 |
| WO | WO 2009/062924 | A2 | 5/2009 |

*Primary Examiner* — Lorna M Douyon

(74) *Attorney, Agent, or Firm* — McKee, Voorhees & Sease, P.L.C.

(57) ABSTRACT

A stability enhancement agent for use in a solid detergent and solid detergent compositions is described. Stability enhancement is provided by a hydratable salt, water and a polyepoxysuccinic acid or polyepoxysuccinic acid metal salt binding agent forming a dimensionally stable composition. Preferred polyepoxysuccinic acid or polyepoxysuccinic acid metal salts have a molecular weight of between about 400 and about 1,500 g/mol. The stability enhancement composition for use in a solid detergent and solid detergent compositions are preferably biodegradable and substantially free of phosphorus and NTA.

16 Claims, No Drawings

(56) References Cited

U.S. PATENT DOCUMENTS

| | | | | |
|---|---|---|---|---|
| 6,653,266 | B2 | 11/2003 | Wei et al. | |
| 6,776,926 | B2 | 8/2004 | Martin | |
| 6,869,503 | B2 | 3/2005 | Thompson et al. | |
| 6,890,404 | B2 | 5/2005 | Thompson et al. | |
| 7,090,780 | B2 | 8/2006 | Ito et al. | |
| 7,172,677 | B2 | 2/2007 | Thompson et al. | |
| 7,300,542 | B2 | 11/2007 | Thompson et al. | |
| 8,361,952 | B2 * | 1/2013 | Silvernail et al. | 510/445 |
| 2003/0010458 | A1 | 1/2003 | Thompson et al. | |
| 2003/0052059 | A1 | 3/2003 | Boyette et al. | |
| 2006/0150892 | A1 | 7/2006 | Mayer | |
| 2007/0125979 | A1 | 6/2007 | Lei et al. | |
| 2008/0169202 | A1 | 7/2008 | Bargeman et al. | |
| 2008/0185340 | A1 | 8/2008 | Bargeman et al. | |
| 2008/0200363 | A1 | 8/2008 | Smets et al. | |
| 2008/0274940 | A1 | 11/2008 | Tjelta et al. | |
| 2008/0274942 | A1 | 11/2008 | Tjelta et al. | |
| 2008/0299665 | A1 | 12/2008 | Xiao et al. | |
| 2009/0011973 | A1 | 1/2009 | Besse et al. | |
| 2009/0176687 | A1 | 7/2009 | Tjelta et al. | |

* cited by examiner

STABILITY ENHANCEMENT AGENT FOR SOLID DETERGENT COMPOSITIONS

CROSS-REFERENCE TO RELATED APPLICATIONS

This application claims priority to and is a continuation of U.S. application Ser. No. 12/844,927 filed on Jul. 28, 2010, hereby incorporated by reference in its entirety.

FIELD OF THE INVENTION

The invention relates to the development of dimensionally stable, solid detergent compositions containing a hydratable salt, water and polyepoxysuccinic acid or metal salt thereof. The compositions according to the invention may be substantially free of phosphorus and NTA. Exemplary polyepoxysuccinic acids or metal salts thereof have a molecular weight of between about 400 and about 1,500.

BACKGROUND OF THE INVENTION

The present invention relates generally to the field of solidification and solidification matrices for detergent compositions. There are numerous solid detergent compositions commercially available that incorporate solidification technology to form solid block detergents. See e.g., U.S. Pat. Nos. RE32,762, RE32,818, 4,595,520 and 4,680,134. Despite the use of solidification technologies, most solid detergents contain hydratable salts and water causing a lack of dimensional stability due to the kinetic and/or thermodynamic instability of the hydratable salts used in the solid compositions.

Soda ash or sodium carbonate is a commonly used hydratable salt that can lead to unstable detergent compositions in the presence of water. Changes in water content or temperature can cause structural and dimensional instability and significantly impact the rate in which the solid composition solidifies. For example, the solid composition may crack, crumble, swell, or become incompatible with dispensing equipment and packaging. The rate of solidification may also be significant in order to optimize the processing of the solid composition. Binding agents may function by controlling the movement of water within a solid composition and/or forming favorable interactions with other components of the composition resulting in a dimensionally stable solid.

Phosphorous-containing binding agents and hardness sequestrants were commonly used for solidification matrices for detergent compositions. However, due to environmental concerns, it is not desirable to use phosphorous-containing compounds. Many products replaced phosphorous-containing binding agents with nitrilotriacetic acid (NTA)-containing components. However, concerns over the carcinogenic effects of NTA-containing components, such as aminocarboxylates, in detergent compositions make these compounds undesirable as well. Therefore, there is an ongoing need to provide alternative phosphorous-free and/or NTA-free solidification technologies for use with solid detergents. However, the lack of predictability in the solidification process and the lack of predictability of dimensional stability in solid compositions have hampered efforts to successfully replace phosphorous and/or NTA-containing components with environmentally-friendly substitutes.

Accordingly, it is an objective of the invention to identify biodegradable binding agents for use in solid detergent compositions.

A further object of the invention is to identify binding agents capable of providing exceptional dimensional stability for a solid detergent composition.

Still further, an object of the invention is to develop such dimensionally stable, solid detergent composition that may be, free of phosphorus and NTA.

BRIEF SUMMARY OF THE INVENTION

A stability enhancement agent for solid compositions is disclosed. The stability enhancement agent can be used for solid detergent compositions providing dimensional stability by controlling water movement within the solid composition or forming favorable interactions with other components in the composition. An embodiment of the invention is a solid detergent matrix that includes a polyepoxysuccinic acid or polyepoxysuccinic acid metal salt, sodium carbonate, and water. Exemplary polyepoxysuccinic acids or polyepoxysuccinic metal acid salts includes Alcosperse 765. The polyepoxysuccinic acid or metal salt thereof, sodium carbonate, and water interact to form a dimensionally-stable solid and may be used, for example, in a solid detergent composition.

Another embodiment of the invention is a solid detergent composition that includes polyepoxysuccinic acid or polyepoxysuccinic acid metal salt, a hydratable salt such as sodium carbonate, water, and optionally a surfactant. The solid detergent composition according to the invention may include between about 1% and about 15% active component percent of polyepoxysuccinic acid by weight, between about 2% and about 50% water by weight, between about 20% and about 80% sodium carbonate by weight, and between about 0.5% and about 10% surfactant by weight.

DETAILED DESCRIPTION OF THE PREFERRED EMBODIMENT

The embodiments of this invention are not limited to particular solid detergent compositions as they may vary as understood by skilled artisans. It is further to be understood that all terminology used herein is for the purpose of describing particular embodiments only, and is not intended to be limiting in any manner or scope. For example, as used in this specification and the appended claims, the singular forms "a," "an" and "the" can include plural referents unless the content clearly indicates otherwise. Further, all units, prefixes, and symbols may be denoted in its SI accepted form. Numeric ranges recited within the specification are inclusive of the numbers defining the range and include each integer within the defined range.

Unless defined otherwise, all technical and scientific terms used herein have the same meaning as commonly understood by one of ordinary skill in the art to which embodiments of the invention pertain. Many methods and materials similar, modified, or equivalent to those described herein can be used in the practice of the embodiments of the present invention without undue experimentation, the preferred materials and methods are described herein. In describing and claiming the embodiments of the present invention, the following terminology will be used in accordance with the definitions set out below.

The term "about," as used herein, refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities and refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like.

The terms "dimensional stability" and "dimensionally stable" as used herein, refer to a solid product having a growth exponent of less than about 3% and particularly less than about 2%. Although not intending to be limited according to a particular theory, the polyepoxysuccinic acid or metal salt thereof is believed to control the rate of water migration for the hydration of sodium carbonate. The polyepoxysuccinic acid or metal salts thereof may stabilize the solid composition by acting as a donor and/or acceptor of free water and controlling the rate of solidification.

The term "weight percent," "wt-%," "percent by weight," "% by weight," and variations thereof, as used herein, refer to the concentration of a substance as the weight of that substance divided by the total weight of the composition and multiplied by 100. It is understood that, as used here, "percent," "%," and the like are intended to be synonymous with "weight percent," "wt-%," etc.

According to embodiments of the invention, the solid compositions overcome a need in the prior art by providing a dimensionally stable solid composition for use in any pressed, extruded or cast solid composition containing a hydratable salt and water. In particular, the composition would be useful for preparing a solid detergent composition that may be employed in any of a wide variety of situations where a dimensionally-stable, phosphorous-free and NTA-free solid product is desired. The embodiments of the present invention are particularly useful in cleaning applications where it is desired to use an environmentally friendly solid detergent.

Solid Detergent Compositions

The solid detergent compositions according to the invention may comprise, consist of and/or consist essentially of a polyepoxysuccinic acid or metal salt thereof, a hydratable salt, and water.

Stability enhancement agent

The solid detergent compositions according to the invention comprise a stability enhancement agent that controls water transfer within a solid composition and/or interacts with a detergent component in a way that achieves dimensional stability According to a preferred embodiment of the invention, the stability enhancement agent is a polyepoxysuccinic acid or any polyepoxysuccinic acid salt, having the following structure:

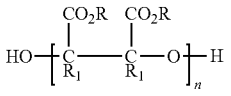

wherein n is an integer of 2 or larger, indicating the number of monomeric units in the polyepoxysuccinic acid polymer; $R_1$ is H or C1-4 alkyl; and R is H or a cation, including for example, Na+, K+ or Li+. Any reference to polyepoxysuccinic acid throughout the description of the invention shall be understood to equally incorporate and include any polyepoxysuccinic acid salt for use as the stability enhancement agent. According to a preferred embodiment of the invention, preferred polyepoxysuccinic acid salts include at least polyepoxysuccinic acid metal salts, including polyepoxysuccinic acid sodium, polyepoxysuccinic acid potassium and polyepoxysuccinic acid lithium salts.

Polyepoxysuccinic acid is a non-phosphorus, non-nitrogenous and environmentally friendly agent that may be synthesized as a combination of various chain-length polyepoxysuccinic acid polymers, therefore for purposes of the present invention the polyepoxysuccinic acid may have various chain length polymers and therefore varying molecular weights. An average molecular weight of the polyepoxysuccinic acid according to the invention is at least 400, with preferred ranges from between about 500 to about 20,000, more preferably from about 400 to about 1,500. According to an embodiment of the invention, the average molecular weight of the polyepoxysuccinic acid is less than about 1,500. The use of salts of polyepoxysuccinic acid increases slightly the molecular weight due to the mass of the cation of the sale relative to the mass of the portion of the acid, as one skilled in the art will understand.

An example of a suitable commercially available polyepoxysuccinic acid sodium salt is Alcosperse 765 (33% active solution of polyepoxysuccinic acid sodium salt), molecular weight 500 g/mol.), available from ALCO Chemical (Chattanooga, Tenn.).

The stability enhancement agent according to the invention may be provided in the ranges from between approximately 1% and approximately 15% by weight of a polyepoxysuccinic acid, from between approximately 1% and approximately 10% by weight polyepoxysuccinic acid, and more particularly from between approximately 2% and approximately 8% by weight polyepoxysuccinic acid.

Hydratable salts

The solid detergent compositions according to the invention comprise at least one hydratable salt. In one embodiment the hydratable salt is sodium carbonate (soda ash or ash). The hydratable salt is provided in the ranges from between approximately 20% and approximately 80% by weight, preferably between approximately 20% and approximately 75% by weight, more preferably between approximately 40% and approximately 75% by weight hydratable salt, such as sodium carbonate. Those skilled in the art will appreciate other suitable component concentration ranges for obtaining comparable properties of the solidification matrix.

In further embodiments, the compositions can include a secondary hydratable salt for a solidification agent. For example, the solidification agent may be inorganic in nature and may also act optionally as a source of alkalinity. In certain embodiments, the secondary solidification agent may include, but are not limited to: alkali metal hydroxides, alkali metal phosphates, anhydrous sodium carbonate, anhydrous sodium sulfate, anhydrous sodium acetate, and other known hydratable compounds or combinations thereof. According to a preferred embodiment, the secondary hydratable salt comprises sodium carbonate, sodium metasilicate or combinations thereof. The amount of secondary solidifying agent necessary to achieve solidification depends upon several factors, including the exact solidifying agent employed, the amount of water in the composition, and the hydration capacity of the other detergent components. In certain embodiments, the secondary solidifying agent may also serve as an alkaline source.

Water

The solid detergent compositions according to the invention comprises water in amounts that vary depending upon techniques for processing the solid composition which may comprise a pressed, extruded and/or cast solid detergent composition. Amounts of water may vary as identified in U.S. patent application Ser. No. 11/969,385, now U.S. Pat. No. 7,763,576 issued Jul. 27, 2010, the disclosure of which is incorporated by reference herein, in its entirety.

According to an embodiment of the invention, the compositions may comprise from between approximately 2% and approximately 50% by weight water, preferably between approximately 2% and approximately 30% by weight water, and more preferably between approximately 2% and approximately 20% by weight water.

Water may further be independently added to the composition or may be provided as a result of its presence in an aqueous material added to the detergent composition. For example, materials added to the detergent composition may include water or may be prepared in an aqueous premix. Typically, water is introduced to provide a desired viscosity for processing prior to solidification and to provide a desired rate of solidification. The water may also be present as a processing aid and may be removed or become water of hydration. The water may thus be present in the form of an aqueous solution of the binding agent, or an aqueous solution of any of the other ingredients, and/or added aqueous medium as an aid in processing. In addition, it is expected that the aqueous medium may help in the solidification process when is desired to form the concentrate as a solid. It should be additionally appreciated that the water may be provided as deionized water or as softened water.

Cleaning Agent

The solid detergent compositions according to the invention may comprise a cleaning agent. The cleaning agent may include a component that provides soil removal properties when dispersed or dissolved in an aqueous solution and applied to a substrate for removal of soil from such substrate. The solid detergent composition can include at least one cleaning agent comprising a surfactant, surfactant system and/or source of alkalinity. A surfactant system refers to a mixture of at least two surfactants. An alkaline source may be included in the solid detergent composition as described in U.S. patent application Ser. No. 11/969,411, now U.S. Pat. No. 7,888,303 issued Feb. 15, 2011,the disclosure of which is incorporated by reference herein its entirety.

According to an embodiment of the invention, the composition may comprise from between about 0.5% and about 20% surfactant or alkalinity source by weight, particularly between about 0.75% and about 10% surfactant or alkalinity source by weight, and more particularly between about 1% and about 5% surfactant or alkalinity source by weight.

A variety of surfactants can be used in a solid detergent composition, including, but not limited to: anionic, nonionic, cationic, and zwitterionic surfactants. Surfactants are an optional component of the solid detergent composition and can be excluded from the concentrate. Exemplary surfactants that can be used are commercially available from a number of sources. For further discussion of surfactants, see Kirk-Othmer, Encyclopedia of Chemical Technology, Third Edition, vol. 8, pages 900-912. When the solid detergent composition includes a cleaning agent, the cleaning agent is provided in an amount effective to provide a desired level of cleaning The solid detergent composition, when provided as a concentrate, can include the cleaning agent in a range of about 0.05% to about 20% by weight, about 0.5% to about 15% by weight, about 1% to about 15% by weight, about 1.5% to about 10% by weight, and about 2% to about 8% by weight. Additional exemplary ranges of surfactant in a concentrate include about 0.5% to about 8% by weight, and about 1% to about 5% by weight.

In addition, the solid detergent compositions according to the invention may additionally comprise additional components or agents, such as additional functional materials, chelating agents, sequestering agents, inorganic detergents, organic detergents, alkaline sources, builders or water conditioners, surfactants, rinse aids, hardening agents, bleaching agents, sanitizers, activators, detergent builders, fillers, defoaming agents, anti-redeposition agents, optical brighteners, dyes, odorants, stabilizing agents, dispersants, enzymes, corrosion inhibitors, thickeners and solubility modifiers. See U.S. patent application Ser. No. 11/969,385, now U.S. Pat. No. 7,763,576 issued Jul. 27, 2010, the disclosure of which is incorporated by reference herein its entirety.

According to an embodiment of the invention the detergent composition may be environmentally friendly and may incorporate biodegradable materials. Preferably, the solid detergent composition excludes phosphorus and/or nitrilotriacetic acid (NTA) containing compounds, making the composition more environmentally acceptable. As used herein, phosphorus-free refers to a composition, mixture, or ingredients to which phosphorus-containing compounds are not added. Also, as used herein, NTA-free refers to a composition, mixture, or ingredients to which NTA-containing compounds are not added. Should phosphorus-containing and/or NTA-containing compounds be present through contamination of a composition, mixture, or ingredient, the level of phosphorus-containing and/or NTA-containing compounds in the resulting composition is less than approximately 0.5 wt-%, less than approximately 0.3 wt-%, and often less than approximately 0.1 wt-% of each compound.

Uses for Solid Detergent Composition

The embodiments of the present invention are particularly useful in cleaning applications. For example, according to the invention the solid detergent compositions can be utilized for any pressed, extruded and/or cast solid detergent compositions. Still further, according to the invention the composition can be utilized for any molded or formed solid pellet, block, tablet, powder, granule, flake or the formed solid can thereafter be ground or formed into a powder, granule, or flake.

In addition, according to the invention the solid composition can further be utilized for any solid compositions containing a hydratable salt and water, including but not limited to uses related to: machine and manual warewashing, presoaks, laundry and textile cleaning and destaining, carpet cleaning and destaining, vehicle cleaning and care applications, surface cleaning and destaining, kitchen and bath cleaning and destaining, floor cleaning and destaining, cleaning in place operations, general purpose cleaning and destaining, industrial or household cleaners, and pest control agents.

In certain embodiments, the solid detergent composition is provided in the form of a unit dose. A unit dose refers to a solid detergent composition unit sized so that the entire unit is used during a single washing cycle. When the solid detergent composition is provided as a unit dose, it is typically provided as a cast solid, an extruded pellet, or a tablet having a size of between approximately 1 gram and approximately 50 grams. In other embodiments, the solid detergent composition is provided in the form of a multiple-use solid, such as a block or a plurality of pellets, and can be repeatedly used to generate aqueous detergent compositions for multiple washing cycles. In certain embodiments, the solid detergent composition is provided as a cast solid, an extruded block, or a tablet having a mass of between approximately 5 grams and approximately 10 kilograms. In certain embodiments, a multiple-use form of the solid detergent composition has a mass between approximately 1 kilogram and approximately 10 kilograms. In further embodiments, a multiple-use form of the solid detergent composition has a mass of between approximately 5 kilograms and about approximately 8 kilograms. In other embodiments, a multiple-use form of the solid detergent composition has a mass of between about approximately 5 grams and approximately 1 kilogram, or between approximately 5 grams and approximately 500 grams.

Methods for Making a Solid Detergent Composition

Without being limited to a particular theory of the invention, the actual mechanism for solidification for compositions according to the invention occurs through ash hydration. See methods of solidification matrix using polymers described in U.S. patent application Ser. No. 11/969,385, now U.S. Pat. No. 7,763,576 issued Jul. 27, 2010, the disclosure of which is incorporated by reference herein its entirety. The polyepoxysuccinic acid stabilizes the carbonate hydrates and therefore the solid composition by acting as a donor and/or acceptor of water. Furthermore, the polyepoxysuccinic acid or metal salt thereof may contribute to the rate of solidification.

The solid detergent composition according to the invention can be created by combining a polyepoxysuccinic acid or metal salt thereof, sodium carbonate, water, and any additional functional components and allowing the components to interact and solidify. For example, in a first embodiment of the invention, the solid detergent composition may include component concentrations in the ranges from between approximately 1% and approximately 15% by weight of a polyepoxysuccinic acid or metal salt thereof, between approximately 2% and approximately 50% by weight water, and between approximately 20% and approximately 80% by weight hydratable salt. In another embodiment, suitable concentrations for the solid detergent compositions range from between approximately 1% and approximately 10% by weight polyepoxysuccinic acid or metal salt thereof, between approximately 2% and approximately 30% by weight water, and between approximately 20% and approximately 75% by weight hydratable salt, such as sodium carbonate. Those skilled in the art will appreciate other suitable component concentration ranges for obtaining comparable properties of the solidification matrix. In another exemplary embodiment, the solid detergent composition includes between about 0.5% and about 10% surfactant by weight, particularly between about 0.75% and about 8% surfactant by weight, and more particularly between about 1% and about 5% surfactant by weight. According to embodiments of the invention, the solid detergent composition is understood to mean a hardened composition that will not flow and will substantially retain its shape under moderate stress or pressure or mere gravity. The degree of hardness of the solid cast composition may range from that of a fused solid product which is relatively dense and hard, for example, like concrete, to a consistency characterized as being a hardened paste. In addition, the term "solid" refers to the state of the detergent composition under the expected conditions of storage and use of the solid detergent composition. In general, it is expected that the detergent composition will remain in solid form when exposed to temperatures of up to approximately 100° F. and preferably up to approximately 120° F.

All publications and patent applications in this specification are indicative of the level of ordinary skill in the art to which this invention pertains. All publications and patent applications are herein incorporated by reference to the same extent as if each individual publication or patent application was specifically and individually indicated by reference.

EXAMPLES

Embodiments of the present invention are further defined in the following non-limiting Examples. It should be understood that these Examples, while indicating certain embodiments of the invention, are given by way of illustration only. From the above discussion and these Examples, one skilled in the art can ascertain the essential characteristics of this invention, and without departing from the spirit and scope thereof, can make various changes and modifications of the embodiments of the invention to adapt it to various usages and conditions. Thus, various modifications of the embodiments of the invention, in addition to those shown and described herein, will be apparent to those skilled in the art from the foregoing description. Such modifications are also intended to fall within the scope of the appended claims.

Example 1

Solid compositions of a stability-enhanced detergent containing a polyepoxysuccinic acid sodium salt were compared to a control (having the same ash to water ratio as the polyepoxysuccinic acid sodium salt composition) as shown below.

Pressed Solid Composition

| Description | Control | EXP1 |
|---|---|---|
| Sodium carbonate | 76.86 | 73.86 |
| Sodium bicarbonate | 3.87 | 3.5 |
| Sodium metasilicate | 4.03 | 4.03 |
| Water | 15.24 | 6.61 |
| Polyepoxysuccinic acid sodium salt, 33% | 0 | 12 |
| total | 100 | 100 |

Water and a polyepoxysuccinic acid sodium salt (commercially available as Alcosperse 765 (33% active solution of polyepoxysuccinic acid sodium salt), molecular weight 600-800 g/mol., neutralized to pH 12.5-13.5 were mixed together thoroughly. In a separate container, sodium carbonate, sodium bicarbonate, and sodium metasilicate were mixed together thoroughly. The liquid premix was gradually added to the dry components while stirring until homogeneous. 50 g of detergent was immediately poured into a circular pressing die and pressed at 1000 psi for 20 seconds. The initial height and diameter of each tablet was measured one hour after the tablets were pressed. These values were used as the initial height and diameter for the stability experiments described below.

Tablets were placed in an oven at 100° F. and 122° F. (two tablets for each composition tested at each given temperature). Experiments were performed with two tablets for each temperature (4 total tablets for each composition). Additional measurements were recorded after 1 and 2 weeks. The percent growth in height and diameter was averaged separately for each tablet and reported with standard deviations. Less than 2% growth in either height or diameter under the most stringent conditions (122° F.) indicated effective control of the binding agent on the dimensional stability of the composition.

Stability Results After 1 Week

| | Temp (F.) | % Growth (Diameter) | % Growth (Height) | Avg. % Growth (Diameter) | Stand. Dev. on (% Growth Diameter) | Average % Growth (Height) | Stand. Dev. on (% Growth Height) |
|---|---|---|---|---|---|---|---|
| Control | 100° | 1.81 | 1.73 | 2.135 | 0.459619 | 2.245 | 0.72832 |
| Control | 100° | 2.46 | 2.76 | | | | |
| Control | 122° | 2.21 | 1.96 | 2.57 | 0.509117 | 2.42 | 0.6505382 |
| Control | 122° | 2.93 | 2.88 | | | | |
| EXP1 | 100° | 0.64 | 0.64 | 0.675 | 0.049497 | 0.455 | 0.2616295 |
| EXP1 | 100° | 0.71 | 0.27 | | | | |
| EXP1 | 122° | 0.00 | −0.91 | 0.02 | 0.028284 | −0.56 | 0.4949747 |
| EXP1 | 122° | 0.04 | −0.21 | | | | |

Stability Results After 2 Weeks

| | Temp (F.) | % Growth (Diameter) | % Growth (Height) | Avg. % Growth (Diameter) | Stand. Dev. on (% Growth Diameter) | Average % Growth (Height) | Stand. Dev. on (% Growth Height) |
|---|---|---|---|---|---|---|---|
| Control | 100° | 1.83 | 1.86 | 2.21 | 0.54 | 2.375 | 0.72832 |
| Control | 100° | 2.59 | 2.89 | | | | |
| Control | 122° | 2.37 | 2.60 | 2.765 | 0.56 | 3.14 | 0.7636753 |
| Control | 122° | 3.16 | 3.68 | | | | |
| EXP1 | 100° | 0.68 | 0.70 | 0.705 | 0.04 | 0.55 | 0.212132 |
| EXP1 | 100° | 0.73 | 0.40 | | | | |
| EXP1 | 122° | 0.13 | −0.78 | 0.185 | 0.08 | −0.335 | 0.629325 |
| EXP1 | 122° | 0.24 | 0.11 | | | | |

The compositions must swell <2% for the binding agent to be considered effective for controlling the dimensional stability of the composition. Under the most extreme conditions (122° F.), the control swelled an average of 3.14% while the composition containing the stability enhancement agent swelled −0.335%.

Additional testing was completed to demonstrate further positive results of the use of the polyepoxysuccinic acid salt as a stability enhancement agent for a solid detergent composition. The percent growth in height and diameter was averaged separately for each tablet and reported with standard deviations as shown below. Growth of <2% in either height or diameter was required to consider the composition dimensionally stable.

Stability Results After 1 Week

| | Temp (F.) | % Growth (Diameter) | % Growth (Height) | Avg. % Growth (Diameter) | Stand. Dev. on (% Growth Diameter) | Average % Growth (Height) | Stand. Dev. on (% Growth Height) |
|---|---|---|---|---|---|---|---|
| Control | 100° | 1.25 | 1.69 | 1.23 | 0.028284 | 1.5 | 0.2687006 |
| Control | 100° | 1.21 | 1.31 | | | | |
| Control | 122° | 1.92 | 2.17 | 2.035 | 0.162635 | 2.17 | 0 |
| Control | 122° | 2.15 | 2.17 | | | | |
| EXP1 | 100° | 0.18 | 0.38 | 0.21 | 0.042426 | 0.325 | 0.0777817 |
| EXP1 | 100° | 0.24 | 0.27 | | | | |
| EXP1 | 122° | 0.56 | 0.26 | 0.75 | 0.268701 | 0.915 | 0.9263099 |
| EXP1 | 122° | 0.94 | 1.57 | | | | |

Stability Results After 2 Weeks

| | Temp (F.) | % Growth (Diameter) | % Growth (Height) | Avg. % Growth (Diameter) | Stand. Dev. on (% Growth Diameter) | Average % Growth (Height) | Stand. Dev. on (% Growth Height) |
|---|---|---|---|---|---|---|---|
| Control | 100° | 1.43 | 2.04 | 1.485 | 0.77782 | 1.935 | 0.1484924 |
| Control | 100° | 1.54 | 1.83 | | | | |
| Control | 122° | 2.44 | 2.48 | 2.55 | 0.0155563 | 2.66 | 0.254558 |
| Control | 122° | 2.66 | 2.84 | | | | |
| EXP1 | 100° | 0.2 | 0.48 | 0.235 | 0.049497 | 0.51 | 0.0424264 |
| EXP1 | 100° | 0.27 | 0.54 | | | | |
| EXP1 | 122° | 0.47 | 0.32 | 0.74 | 0.381838 | 0.97 | 0.9192388 |
| EXP1 | 122° | 1.01 | 1.62 | | | | |

The results demonstrate that under the most extreme conditions (122° F.), the control swelled an average of 2.66% while the composition containing the experimental binding agent swelled 0.97%. The duplicated data confirms the presence of polyepoxysuccinic acid provides dimensional stability to the sodium carbonate (ash) and water composition compared to the control without binding agent. The average percent growth in height and diameter for all experiments under the most extreme conditions is reported in the table below:

Results Summary

| | Temp (F.) | % Growth (Diameter) | % Growth (Height) | Avg. % Growth (Diameter) | Stand. Dev. on (% Growth Diameter) | Average % Growth (Height) | Stand. Dev. on (% Growth Height) |
|---|---|---|---|---|---|---|---|
| Control | 122° | 2.6 | 2.37 | 2.90 | 0.54 | 2.66 | 0.36 |
| Control | 122° | 3.68 | 3.16 | | | | |
| Control | 122° | 2.48 | 2.44 | | | | |
| Control | 122° | 2.84 | 2.66 | | | | |
| EXP1 | 122° | 0.13 | −0.78 | 0.32 | 0.99 | 0.47 | 0.41 |
| EXP1 | 122° | 0.24 | 0.11 | | | | |
| EXP1 | 122° | 0.47 | 0.32 | | | | |
| EXP1 | 122° | 1.04 | 1.62 | | | | |

The combined results under the most extreme conditions verify the effectiveness of polyepoxysuccinic acid (sodium salt) as a binding agent for controlling dimensional stability of compositions containing sodium carbonate and water.

The inventions being thus described, it will be obvious that the same may be varied in many ways. Such variations are not to be regarded as a departure from the spirit and scope of the inventions and all such modifications are intended to be included within the scope of the following claims.

What is claimed is:

1. A stability enhancement composition for use in a solid detergent comprising:

between about 1% and about 15% polyepoxysuccinic acid or polyepoxysuccinic acid salt by weight;

between about 65% and about 80% hydratable salt by weight;

between 2% and about 10% water by weight; and wherein the composition is a solid hydrate that is phosphorus-free and NTA-free, and wherein if heated at a temperature of 122 degrees Fahrenheit, the solid is dimensionally stable and has a growth exponent of less than 3% and wherein the composition does not contain chelating agents.

2. The composition of claim 1 wherein the polyepoxysuccinic acid or polyepoxysuccinic acid salt has a molecular weight of between about 400 and 1,500 g/mol.

3. The composition of claim 1 further comprising at least one functional ingredient.

4. The composition of claim 3 wherein the functional ingredient is selected from the group consisting of: alkaline sources, builders, water conditioners, rinse aids, hardening agents, bleaching agents, sanitizers, activators, inorganic detergents, organic detergents, surictants, fillers, defoaming agents, anti-redeposition agents, optical brighteners, dyes, odorants, stabilizing agents, dispersants, enzymes, corrosion inhibitors, thickeners and solubility modifiers.

5. A stability enhancement composition for use in a solid detergent comprising:

between about 1% and about 15% polyepoxysuccinic acid or polyepoxysuccinic acid salt by weight, wherein the polyepoxysuccinic acid or polyepoxysuccinic acid salt has a molecular weight of between about 400 and 1,500 g/mol;

between about 65% and about 80% sodium carbonate by weight;

between about 2% and about 10% water by weight; and wherein the composition is a solid hydrate that is phosphorus-free and NTA-free, and is dimensionally stable demonstrating a growth exponent of less than about 3% when heated at a temperature of 122 degrees Fahrenheit and wherein the composition does not contain chelating agents.

6. The composition of claim 5 wherein the polyepoxysuccinic acid or polyepoxysuccinic acid salt constitutes between about 2% and about 8% by weight of the composition.

7. The composition of claim 5 further comprising at least one functional ingredient, wherein the functional ingredient is selected from the group consisting of: alkaline sources, builders, water conditioners, rinse aids, hardening agents, bleaching agents, sanitizers, activators, inorganic detergents, organic detergents, surfactants, fillers, defoaming agents, anti-redeposition agents, optical brighteners, dyes, odorants, stabilizing agents, dispersants, enzymes, corrosion inhibitors, thickeners and solubility modifiers.

8. A solid detergent composition comprising:

an alkalinity source;

between about 1% and about 15% polyepoxysuccinic acid or polyepoxysuccinic acid salt by weight having a molecular weight of between about 400 and 800 g/mol;

between about 65% and about 75% sodium carbonate by weight;

between 2% and about 10% water by weight;

wherein the detergent composition is solid hydrate that is phosphorus-free and NTA-free, and is dimensionally stable demonstrating a growth exponent of less than about 3% when heated at a temperature of 122 degrees Fahrenheit; wherein the detergent composition does not contain chelating agents; and wherein the solid detergent composition is a pressed, extruded or cast solid composition.

9. The composition of claim 8 further comprising at least one functional ingredient, wherein the functional ingredient is selected from the group consisting of: alkaline sources, builders, water conditioners, rinse aids, hardening agents, bleaching agents, sanitizers, activators, inorganic detergents, organic detergents, surfactants, fillers, defoaming agents, anti-redeposition agents, optical brighteners, dyes, odorants, stabilizing agents, dispersants, enzymes, corrosion inhibitors, thickeners and solubility modifiers.

10. A solid detergent composition comprising:

between about 1% and about 15% polyepoxysuccinic acid or polyepoxysuccinic acid salt by weight, wherein the polyepoxysuccinic acid or polyepoxysuccinic acid salt has a molecular weight of about 500 g/mol;

between about 65% and about 80% sodium carbonate by weight; and between about 2% and about 10% water by weight;

wherein the detergent composition is a solid hydrate that is phosphorus-free and NTA-free, and is dimensionally stable demonstrating a growth exponent of less than about 2% when heated at a temperature of 122 degrees Fahrenheit and wherein the detergent composition does not contain chelating agents.

11. The composition of claim 10 wherein the polyepoxysuccinic acid or polyepoxysuccinic acid salt constitutes between about 2% and about 8% by weight of the composition.

12. The composition of claim 10 further comprising an alkalinity source,

13. The composition of claim 10 wherein the solid detergent composition is a pressed, extruded or cast solid composition.

14. The composition of claim 10 further comprising at least one functional ingredient, wherein the functional ingredient is selected from the group consisting of: alkaline sources, builders, water conditioners, rinse aids, hardening agents, bleaching agents, sanitizers, activators, inorganic detergents, surfactants, organic detergents, fillers, defoaming agents, anti-redeposition agents, optical brighteners, dyes, odorants, stabilizing agents, dispersants, enzymes, corrosion inhibitors, thickeners and solubility modifiers.

15. A method of using a solid detergent composition comprising:

providing a pressed, extruded or cast solid detergent composition for a cleaning application;

forming an aqueous solution of said detergent composition; and applying said aqueous solution to a substrate for removal of soil;

wherein said solid detergent composition comprises an alkalinity source, between about 1% and about 15% polyepoxysuccinic acid or polyepoxysuccinic acid salt by weight having a molecular weight of between about 400and 800 g/mol, between about 65% and about 75% sodium carbonate by weight, and between 2% and about 10% water by weight; and wherein the detergent composition is a solid hydrate that is phosphorus-free and NTA-free, and is dimensionally stable demonstrating a growth exponent of less than about 3% when heated at a temperature of 122 degrees Fahrenheit and wherein the detergent composition does not contain chelating agents.

16. The method of claim 15 wherein the cleaning application is machine ware washing, manual warewashing, presoaks, laundry cleaning and destaining, textile cleaning and destaining, carpet cleaning and destaining, vehicle cleaning and care applications, surface cleaning and destaining, kitchen and bath cleaning and destaining, floor cleaning and destaining, cleaning in place operations, general purpose cleaning and destaining, industrial or household cleaners, and/or pest control agents.

* * * * *